US005998344A

United States Patent [19]

Christensen et al.

[11] Patent Number: 5,998,344

[45] **Date of Patent: *Dec. 7, 1999**

[54] DETERGENT COMPOSITION COMPRISING A GLYCOLIPID AND ANIONIC SURFACTANT FOR CLEANING HARD SURFACES

[75] Inventors: Poul Nørgaard Christensen, Lyngby; Bo Kalum, Copenhagen; Otto Andresen, Stenløse, all of Denmark

[73] Assignee: Novo Nordisk A/S, Bagsvaers, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 09/004,189

[22] Filed: Jan. 8, 1998

Related U.S. Application Data

[62] Division of application No. 08/549,833, filed as application No. PCT/DK94/00176, May 4, 1994.

[30] Foreign Application Priority Data

May 4, 1993 [DK] Denmark ..... 526/93
Mar. 10, 1994 [DK] Denmark ..... 279/94

[51] Int. Cl.[6] ..... C11D 1/12; C11D 3/22; C11D 3/386

[52] U.S. Cl. ..... 510/218; 510/123; 510/124; 510/129; 510/158; 510/220; 510/221; 510/226; 510/235; 510/237; 510/280; 510/300; 510/320; 510/321; 510/333; 510/336; 510/340; 510/343; 510/353; 510/370; 510/373; 510/374; 510/382; 510/389; 510/392; 510/399; 510/437; 510/481; 510/503

[58] Field of Search ..... 510/123, 124, 510/129, 158, 220, 221, 226, 235, 237, 280, 300, 320, 321, 333, 336, 340, 343, 353, 370, 373, 374, 382, 389, 392, 399, 437, 481, 491, 503

[56] References Cited

U.S. PATENT DOCUMENTS

| | | | |
|---|---|---|---|
| 3,940,433 | 2/1976 | Lamberti et al. | 260/458 |
| 4,195,077 | 3/1980 | Marsh et al. | 424/70 |
| 4,588,514 | 5/1986 | Jones et al. | 252/98 |
| 4,614,606 | 9/1986 | Machin et al. | 252/116 |
| 4,695,394 | 9/1987 | Choy et al. | 252/97 |
| 4,747,977 | 5/1988 | Whitehead et al. | 252/111 |
| 4,793,943 | 12/1988 | Haslop et al. | 252/135 |
| 4,842,757 | 6/1989 | Reboa et al. | 252/76 |
| 5,190,747 | 3/1993 | Sekiguchi et al. | 424/56 |
| 5,191,071 | 3/1993 | Kirk et al. | 536/4.1 |
| 5,200,328 | 4/1993 | Kirk et al. | 435/101 |
| 5,248,434 | 9/1993 | Nicholson | 252/95 |
| 5,320,783 | 6/1994 | Marin et al. | 252/544 |
| 5,348,682 | 9/1994 | Finley et al. | 252/186.36 |
| 5,507,970 | 4/1996 | Ishikawa et al. | 252/174.17 |
| 5,529,711 | 6/1996 | Brodbeck et al. | 252/102 |

*Primary Examiner*—Mark Kopec
*Assistant Examiner*—Charles Boyer
*Attorney, Agent, or Firm*—Steve T. Nelson; Carol E. Rozek

[57] ABSTRACT

Disclosed for cleaning hard surfaces is a detergent gel containing:

(a) a detergent composition without thickeners having
  (i) a first surfactant, wherein the first surfactant is a non-ionic glycolipid, and
  (ii) a second surfactant, wherein the second surfactant is a charged surfactant, wherein the ratio of the first surfactant and the second surfactant is 1:10–10:1;

(b) water, wherein the detergent composition is mixed with a sufficient amount of water to induce a phase change from a liquid phase to a gel phase; and (c) one or more enzymes.

5 Claims, 4 Drawing Sheets

DETERGENT COMPOSITION COMPRISING A GLYCOLIPID AND ANIONIC SURFACTANT FOR CLEANING HARD SURFACES

CROSS-REFERENCE TO RELATED APPLICATIONS

This application is a divisional of application Ser. No. 08549,833 filed Nov. 3, 1995 which is a 371 of PCT/DK94/00176 filed May 4, 1994 and claims priority under 35 U.S.C. 119 of Danish applications 526/93 filed May 5, 1993 and 279/94 filed Mar. 10, 1994, the contents of which are fully incorporated herein by reference.

FIELD OF INVENTION

This invention relates to a detergent composition for cleaning hard surfaces with superior cleaning qualities.

BACKGROUND OF THE INVENTION

In food industry hard surface cleaning has traditionally been carried out by high pressure foam cleaning. There are some severe safety problems by using high pressure foam cleaning: High pH, aggressive cleaning agents, aerosol formation and mechanical noise and damage are the most important ones, but there are also environmental problems connected to high pressure foam cleaning due to a large water consumption and thereby effluent treatment.

It has also been excluded to add enzymes to the detergents in the normal hard surface cleaning. The risk of inhaling enzymes (allergy potential) due to aerosol formation is so obvious that it rules out the use of enzymes in the traditional high pressure foam cleaning.

To overcome these difficulties in recent years much effort has been put into developing different hard surface cleaners in the form of gels. The gel cleaners have the advantages of giving a safe application, they do not or only insignificantly create aerosols, they have a low water consumption, so if the cleaning capacity of the gel is satisfactory, the gel application method is a safe and gentle way of cleaning hard surfaces.

SUMMARY OF THE INVENTION

In this invention it is surprisingly found that a special gel cleaning composition with enzyme(s), which contains no thickeners, has extraordinary good cleaning capacities on hard surfaces.

Accordingly, the present invention relates to a detergent composition for cleaning hard surfaces, the composition comprising one surfactant together with an electrolyte or more than one surfactant, optionally together with an electrolyte, which composition is capable of forming a gel when water is added, the composition further comprising one or more enzymes.

BRIEF DESCRIPTION OF DRAWINGS

The present invention is further illustrated by reference to the accompanying drawings, in which.

DETAILED DISCLOSURE OF THE INVENTION

Gel Compositions

Figure 1:
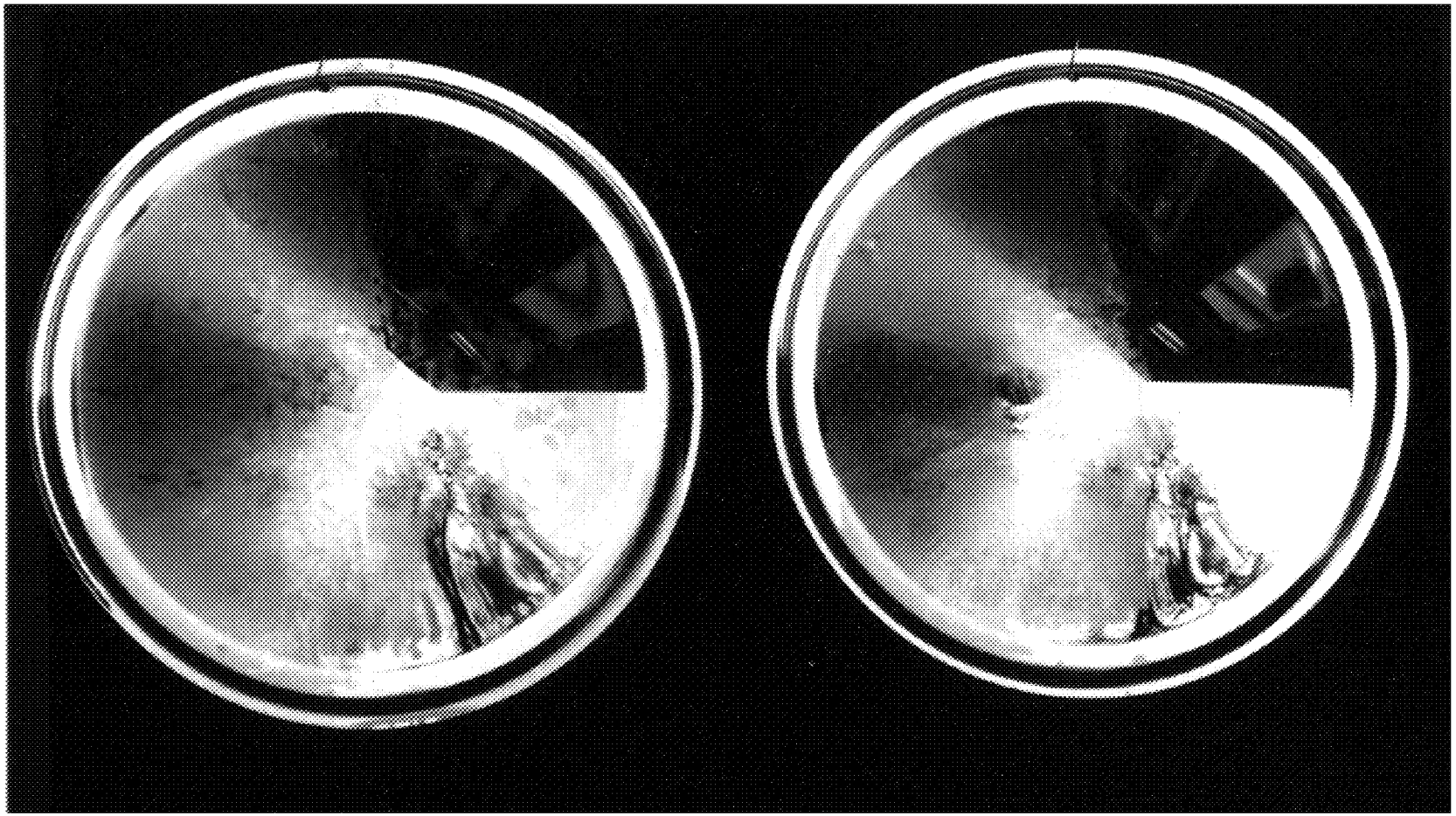
FIG. 1 shows the cleaning result of the $C_{14}$ dimethyl amine oxide/sodium oleate/protease gel, pH 12 (top), pH 10.1 (bottom), half the lid with enzyme, the other half without enzyme, the gel produced as described in Example 1.

Gel cleaning agents containing one or more enzymes for use as industrial hard surface cleaners have been described before (see Research Disclosure, August 1992, p.619, No.34045). These gels are characterized by containing at least one or more surfactants, builders, thickeners and one or more enzymes.

According to the invention, it is preferred to add enzyme (s) to a special gel cleaning composition which contains no thickeners. (Gels containing thickeners are described in Research Disclosure, August 1992, p.619, No.34045). Basically these gels are made of one surfactant together with an electrolyte or more than one surfactant, optionally together with an electrolyte, which composition is capable of forming a gel when water is added. Some surfactants have this special capacity; in the present invention it has been found that there may be two surfactants, the first surfactant may be an amine oxide or a betaine or a tetraalkylammoniumchloride and the second surfactant an alkali metal salt of a fatty acid, or the first surfactant may be a nonionic glycolipid and the second surfactant a charged surfactant, preferably an anionic surfactant, preferably sodium lauryl sulfate or sodium lauryl ether sulfate.

The amine oxide may be one of the general formula

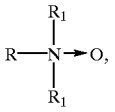

where R=$C_{12}$–$C_{18}$, and $R_1$ is the same or different and selected from alkyl, substituted alkyl, aryl or substituted aryl. An example of a suitable amine oxide is $C_{14}$ dimethyl amine oxide.

The betaine may be one of the general formula

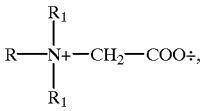

where R=$C_{12}$–$C_{18}$, and $R_1$ is the same or different and selected from alkyl, substituted alkyl, aryl or substituted aryl. An example of a suitable betaine is $C_{12-14}$ alkyl dimethyl betaine, in which $C_{12-14}$ alkyl is derived from coconut.

The tetraalkylammoniumchloride may be one of the general formula

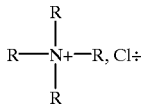

where R is the same or different and selected from alkyl or substituted alkyl.

The alkali metal salt of a fatty acid may be one of the general formula

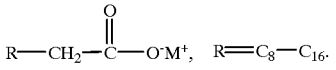

An example of a suitable alkali metal salt of a fatty acid is sodium oleate.

The glycolipid may be a sugar or sugar alcohol fatty acid ester (as described in JP 63-112,993) or a derivative thereof or a fatty acid monoester or a mixture of fatty acid monoesters of alkylglycoside (as described in U.S. Pat. No. 5,191,071 and in U.S. Pat. No. 5,200,328) or a derivative thereof.

The ratio of the first surfactant (the amine oxide or the betaine or the tetraalkylammoniumchloride or the glycolipid) and the second surfactant (the alkali metal salt of a fatty acid or the charged surfactant) is suitably 1:10–10:1, preferably 1:1–10:1.

The gel composition may optionally also contain other detergent ingredients such as solvents and seguestrants.

The gel composition may also contain an electrolyte (e.g. sodium chloride) to induce gel formation or increase gel strength. When all the components except the enzyme(s) are added, the pH is adjusted to less than 12.5. This detergent composition is admixed with water to a total water concentration of 10–80%, preferably 20–70%, more preferably 40–60%. At this concentrated form the detergent composition is an easily pumpable liquid.

Then one or more enzymes are added to the surfactant composition of the present invention. The enzymes are in particular proteases (for instance Savinasee 16.0 L, Alcalase® 2.5 L, Esperase® 8.0 L or Durazymm™ 16.0 L, all available from Novo Nordisk A/S), amylases (for instance Termamyl® 300 L available from Novo Nordisk A/S), lipases (for instance Lipolase™ 100 L available from Novo Nordisk A/S) or cellulases (for instance Celluzyme™ 1.0 L available from Novo Nordisk A/S). The amount of technical enzyme may be dosed so that the percentage of enzyme in the finished gel will be of 0.001–10%, preferably 0.01–1%, in particular about 0.01–0.1%.

The above mentioned surfactant combination forms a gel when water is added. The gel formation may be promoted by an electrolyte which may be present in the concentrated detergent composition or in the water added to generate the gel. This reflects the well known fact that in a triangular phase diagram describing a ternary system (first surfactant, second surfactant, water) changes in the mole fractions often lead to phase transition, e.g. the transition from a liquid phase to a gel phase. It is also known that this phase transition may be reversed by changing the mole fraction.

It has surprisingly been found that the enzymes perform extremely well in the surfactant system of the present invention despite the impaired diffusion possibility of the macro-molecular enzymes in the gel network. This can be explained by the gel being in a dynamic state of constant micelle reformation generating a stirring action in situ.

Gel Making in situ

The gel is made in situ. The detergent composition comprising the surfactants, the enzyme(s) and optionally the electrolyte are diluted with water and applied to the soiled surfaces by using some kind of application system (e.g. diluted through a venturi and applied via a special lance). The detergent composition is best applied using gel generation equipment which automatically draws in the required percentage. Application equipment is available from for instance Scanio A/S, Blytaekkervej 4–6, DK-9000 Aalborg, Denmark.

In order to make the proper gel, the water used for mixing should be added in an amount so as to generate a final surfactant concentration in the range of 0.1–25%, preferably in the range of 0.5–10%.

Cleaning Hard Surfaces

The gel is applied to the soiled surfaces as described above. The gel will set on the surfaces within a few seconds. The enzymes will participate in the degradation of protein (proteases), starch (amylases), lipid (lipases) and cellulose (cellulases) residues. The gel will remain in its form even on complicated shaped equipment, vertical surfaces and ceilings and will therefore give very long contact times. Dwell times are difficult to estimate beforehand and should be determined by trial. A dwell time of 5–30 minutes may often be required.

After a sufficient dwell time to allow for enzyme and surfactant action the gel composition is rinsed off using a washing system. In some cases it may be necessary to use a pressure washing system to rinse off the gel composition, but often removal by gentle flushing with water is easy and all that is needed.

Evaluation of the Cleaning Results

In the present invention the efficiency of the detergent formulations on hard surfaces is evaluated visually. This is of course a primitive method, but for the skilled eye the best there is today.

Potential Applications

The enzyme gel detergent described in this invention may be used in all kinds of food industries: in dairies, in slaughterhouses, in breweries, in sea food production units etc. It may also be used in the transport sector, for instance as a cleaning agent in car washing and for general vessel wash. It may also work as a general purpose cleaner in households, for instance as an efficient oven cleaner.

The invention is further illustrated in the following example which is not intended to be in any way limiting to the scope of the invention as claimed.

EXAMPLE 1

Test of an Enzyme Gel Detergent on Hard Surfaces with Protein Soils

Protein Soils 3 whole eggs and 50 ml of skimmed milk were blended together at lowest speed in a Braun UK20 for 1 min. This mixture was poured over the curved side of a stainless steel lid. The lid was left to dry for at least 4 hours at room temperature in a drying rack where excess soil drained off. Before use the soiled lid was dipped in boiling water for 30 sec. In this way the soil was made more difficult to remove.

Treatment with Protease Gel Detergent (Amine Oxide and Sodium Oleate)

A detergent composition made of 10.0% dipropylene glycol monomethyl ether 16.0% $C_{14}$ dimethyl amine oxide 5.3% oleic acid 2.2% NaOH (47%)

11.0% NaCl 10.0% triethanolamine (85%)

8.0% Dequest 2000

37.5% water was prepared. After addition of each of the components the mixture was blended. After addition of the last component pH was 10.1. In a sample pH was adjusted to 12.0. A gel was made of the detergent composition, protease (Savinase 16.0 L) and water in such a way that the water content of the ready-to-use gel was 96.5%, and the enzyme content was 0.5%.

The gel was smeared evenly over the top surface of the lid with a pastry brush. After a dwell time of 10 min. water (35–40° C.) was rinsed over the lid. Then the lid was left to dry. In order to see the effect of the enzyme one half of the lid was treated with gel plus enzyme and the other half of the lid was treated with gel without the enzyme.

FIG. 1 shows the result when pH of the gel is 12.0 (top) and when pH of the gel is 10.1 (bottom). It goes without saying that the effect of the enzyme is remarkable.

Treatment with Protease Gel Detergent (Betaine and Sodium Oleate)

A detergent composition made of 10.0% dipropylene glycol monomethyl ether 16.0% $C_{12-14}$ alkyl dimethyl betaine 5.3% oleic acid 2.2% NaOH (47%)

13.0% Na(dl 10.0% triethanolamine (85%)

8.0% Dequest 2000

35.5% water was prepared. After addition of each of the components the mixture was blended. After addition of the last component pH was 7.0. In a sample pH was adjusted to 12.0. A gel was made of the detergent composition, protease (Savinase 16.0 L), and water in such a way that the content of detergent composition was 15% and the enzyme content was 0.5%.

The gel was smeared evenly over the top surface of the lid with a pastry brush. After a dwell time of 10 min. water (35–40° C.) was rinsed over the lid. Then the lid was left to dry. In order to see the effect of the enzyme one half of the lid was treated with gel plus enzyme and the other half of the lid was treated with gel without the enzyme.

Figure 2:
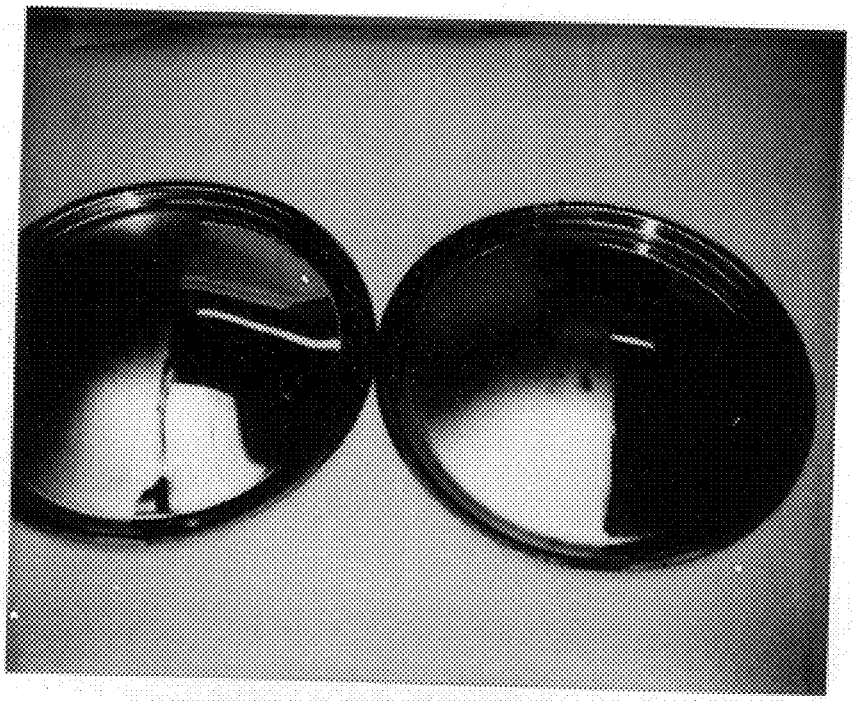
FIG. 2 shows the cleaning result of the $C_{12-14}$ alkyl dimethyl betaine/sodium oleate/protease gel, pH 12, half the lid with enzyme, the other half without enzyme, the gel produced as described in Example 1.

FIG. 2 shows the result. The effect of the enzyme is remarkable.

Treatment with Protease Gel Detergent (6-0-dodecanoyl Glycoside and Sodium Dodecyl Ether Sulfate)

A detergent composition made of 47.98% water

3% sodium dodecyl ether sulfate 0.02% citric acid

15% propyleneglycol

7% dipropylene glycol monomethyl ether

25% 6-0-dodecanoyl glycoside

2% oleic acid was prepared. Components were added in the order stated, starting with water, with thorough mixing after each addition. After addition of the last component, pH was approximately 4. In one sample of detergent, pH was adjusted to 8.0 with NaOH.

A gel was made of the detergent composition, protease (Savinase 16.0 L) and water in such a way that the water content of the final gel was 82.7%, and the enzyme content was 0.5%.

The gel was smeared evenly over the top surface of the lid with a pastry brush. After a dwell time of 10 min. water (handwarm) was rinsed over the lid accompanied by a gentle mechanical manual treatment. Then the lid was left to dry. In order to see the effect of the enzyme, one half of the lid was treated with gel plus enzyme, and the other half of the lid was treated with gel without enzyme.

Figure 3:
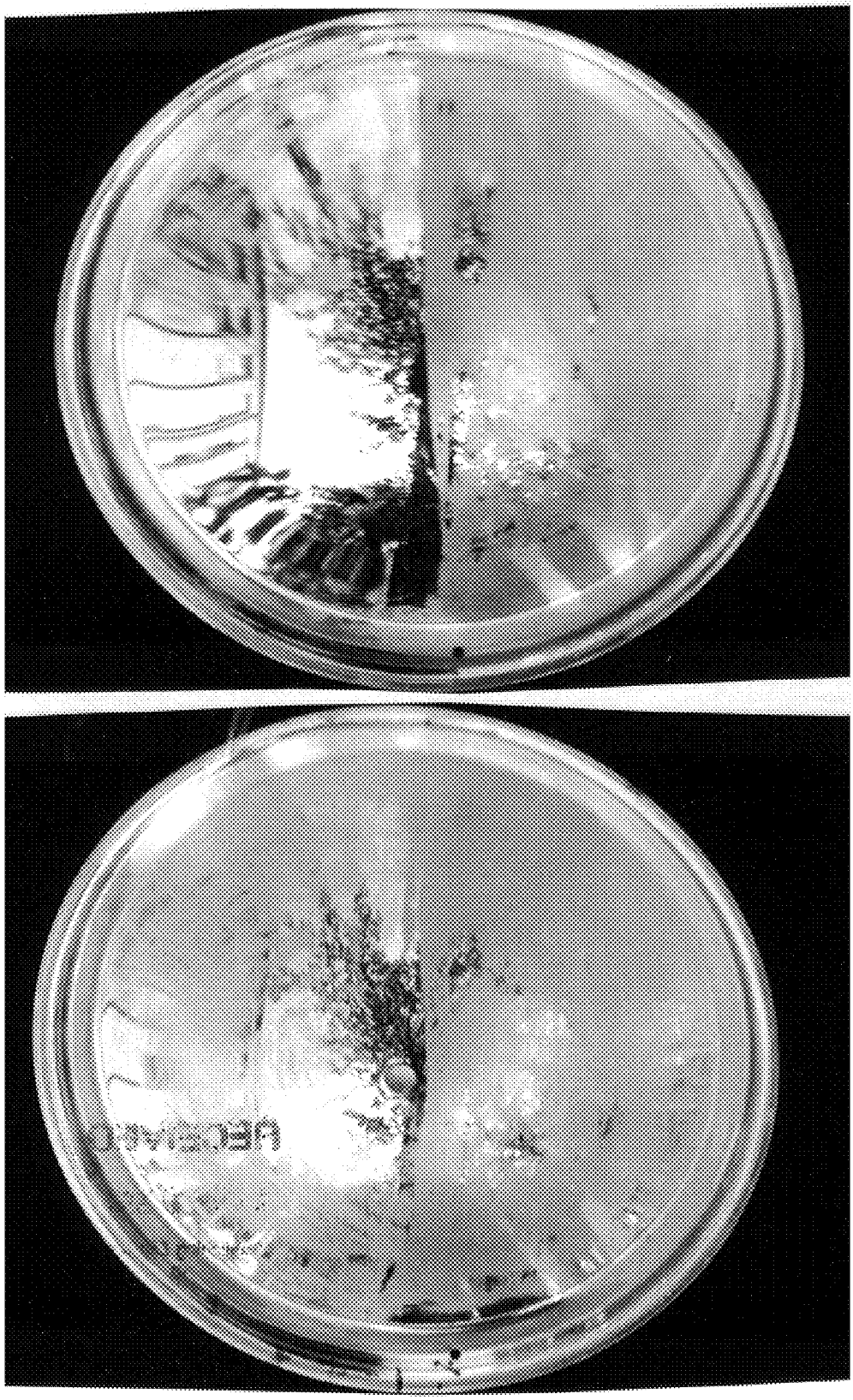
FIG. 3 shows the cleaning result of the 6-0-dodecanoyl glycoside/sodium dodecyl ether sulfate/protease gel, pH 4 (bottom), pH 8 (top), half the lid with enzyme, the other half without enzyme, the gel produced as described in Example 1.

FIG. 3 shows the result when pH of the gel is 4 (bottom) and when pH of the gel is 8 (top). The effect of the enzyme is remarkable.

EXAMPLE 2

Test of an Enzyme Gel Detergent on Hard Surfaces with Starch Soils

Starch Soils 60 g of corn starch were dissolved in 1.5 litres of water and blended for 10 minutes. Then 1.5 litres of water were added, and the mixture was cooked for 10 minutes, whereafter it was left to cool to 60° C.

Stainless steel lids were one by one pulled through the solution in a tray.

The lids were left to dry until next day.

Treatment with Amylase Gel Detergent (6-0-dodecanoyl Glycoside and Sodium Dodecyl Sulfate)

A detergent composition made of 49.7% water

5% sodium dodecyl sulfate 0.3% $Na_2SO_4$

10% propyleneglycol

25% 6-0-dodecanoyl glycoside

5% oleic acid

5% dipropylene glycol monomethyl ether was prepared. Components were added in the order stated, starting with water, with thorough mixing after each addition. After addition of the last component, pH was adjusted to 7 with NaOH.

A gel was made of the detergent composition, amylase (Termamyl 60 L) and water in such a way that the water content of the final gel was 83.3%, and the enzyme content was 0.1%.

The gel was smeared evenly over the top surface of the lid with a pastry brush. After a dwell time of 15 min. water (handwarm) was rinsed over the lid. A Iodine solution was sprayed over the lid to develop remaining starch. In order to see the effect of the enzyme, one half of the lid was treated with gel plus enzyme, and the other half of the lid was treated with gel without enzyme.

Figure 4:
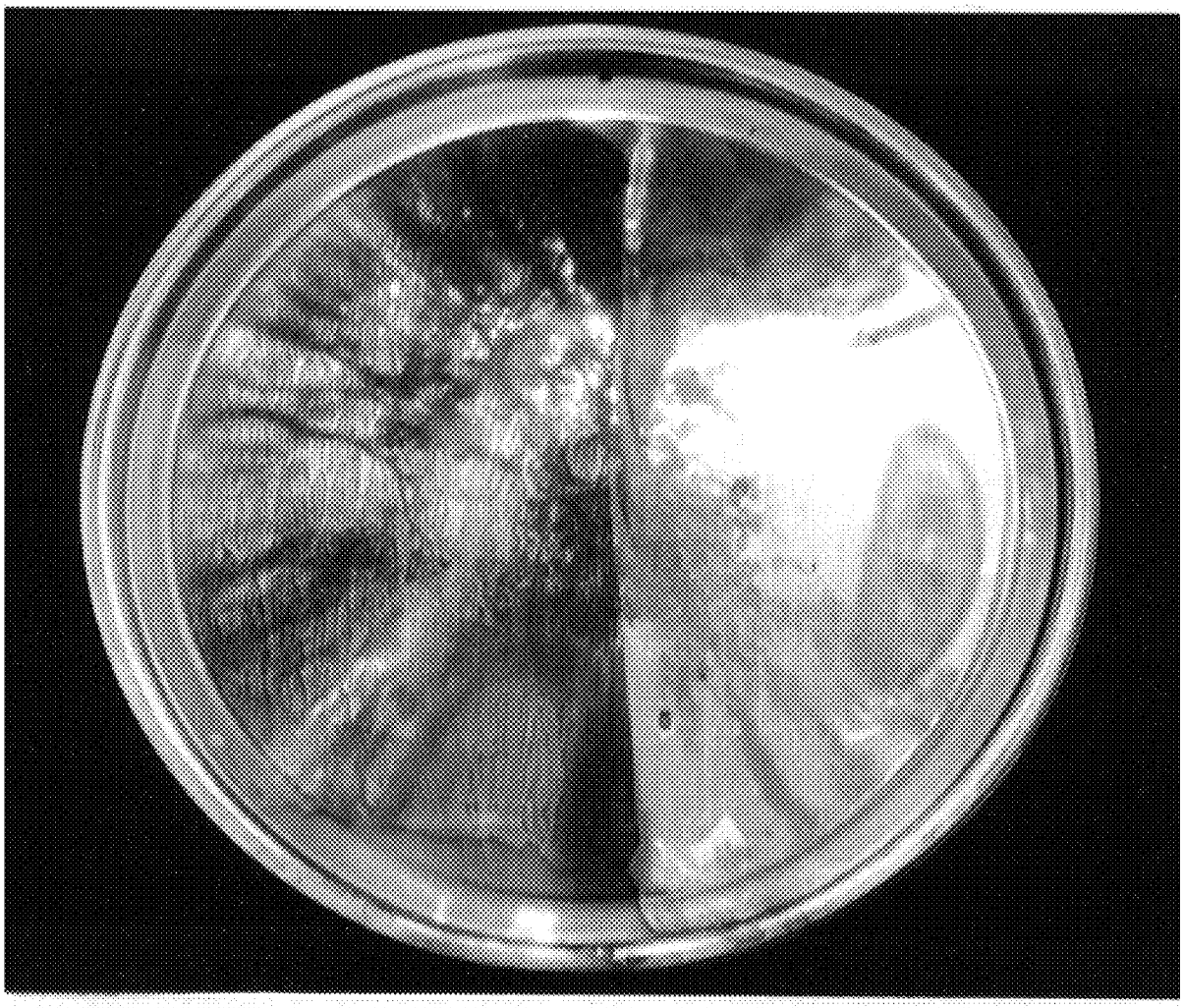
FIG. 4 shows the cleaning result of the 6-0-dodecanoyl glycoside/sodium dodecyl sulfate/amylase gel, pH 7, half the lid with enzyme, the other half without enzyme, the gel produced as described in Example 2.

FIG. 4 shows the result when pH of the gel is 7. The effect of the enzyme is remarkable.

We claim:

1. A detergent gel for cleaning hard surfaces, comprising:

(a) a detergent composition without thickeners comprising (i) a first surfactant, wherein the first surfactant is a non-ionic glycolipid, and (ii) a second surfactant, selected from the group consisting of sodium dodecyl sulfate and sodium dodecyl ether sulfate, wherein the ratio of the first surfactant to the second surfactant is 1:10–10:1;

(b) water, wherein said detergent composition is mixed with a sufficient amount of water to induce a phase change from a liquid phase to a gel phase; and (c) from 0.001 to 10% of one or more enzymes.

2. A detergent gel as defined in claim 1, wherein the glycolipid is selected from the group consisting of (i) a sugar or sugar alcohol fatty acid ester or a derivative thereof and (ii) one or more fatty acid monoesters of alkylglycoside or a derivative thereof.

3. A detergent gel as defined in claim 2, wherein the alkylglycoside is ethylglycoside and the fatty acids contain 8–22 carbon atoms.

4. A detergent gel as defined in claim 3, wherein the glycolipid is ethyl 6-0-dodecanoyl glycoside.

5. A detergent gel as defined in claim 1, wherein the enzyme is selected from the group consisting of proteases, amylases, cellulases, and lipases.

* * * * *